US008167228B2

(12) United States Patent
Kobayashi et al.

(10) Patent No.: US 8,167,228 B2
(45) Date of Patent: May 1, 2012

(54) ROLL RECORDING MATERIAL TRANSPORT DEVICE AND RECORDING APPARATUS

(75) Inventors: Masaki Kobayashi, Suwa (JP); Kiyoto Komuro, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 560 days.

(21) Appl. No.: 12/400,099

(22) Filed: Mar. 9, 2009

(65) Prior Publication Data

US 2009/0226235 A1 Sep. 10, 2009

(30) Foreign Application Priority Data

Mar. 10, 2008 (JP) ..... 2008-059757

(51) Int. Cl.
*B65H 23/18* (2006.01)

(52) U.S. Cl. ..... 242/418; 242/418.1; 242/420.5; 242/564.4

(58) Field of Classification Search ..... 242/41, 242/420, 420.5, 421, 421.7, 356.5, 564.48; 400/613, 618

See application file for complete search history.

(56) References Cited

U.S. PATENT DOCUMENTS 6,435,446 B1 * 8/2002 Matsuzawa ..... 242/422.4
6,622,953 B2 9/2003 Inana et al.
6,923,397 B2 8/2005 Inana et al.
7,100,859 B2 * 9/2006 Kayanuma et al. ..... 242/348
7,168,650 B2 1/2007 Inana et al.
2007/0034727 A1 * 2/2007 Kaya ..... 242/571.8
2008/0239052 A1 * 10/2008 Ishii et al. ..... 347/104

FOREIGN PATENT DOCUMENTS

JP 2001-171868 6/2001
JP 2007-245544 9/2007
JP 2007-245545 9/2007
JP 2007-261085 10/2007
JP 2007-290866 11/2007

* cited by examiner

*Primary Examiner* — Seung Lee
*Assistant Examiner* — Christle Marshall
(74) *Attorney, Agent, or Firm* — Workman Nydegger

(57) ABSTRACT

A roll recording material transport device includes a driving side roll holder, a driven side roll holder, a driving side spindle, a driven side spindle, a spindle driving source, a driving side support mechanism, a driven side support mechanism, a transport roller, and an assist executing section. The assist executing section executes assist control in which a rotating force in the direction of transporting the roll of recording material is applied by the spindle driving source through the driving side spindle and the driving side roll holder in an engaged state to the roll portion. The frictional force between the driving side spindle and the driving side roll holder is set smaller than the frictional force between the driven side spindle and the driven side support mechanism.

5 Claims, 12 Drawing Sheets

(TENSION CONTROL)

(UNSTABLE STATE)

(ASSIST CONTROL)

ROLL RECORDING MATERIAL TRANSPORT DEVICE AND RECORDING APPARATUS

BACKGROUND

1. Technical Field

The present invention relates to a roll recording material transport device having an assist executing section that executes assist control in which a rotating force is applied to a roll portion of a roll of recording material in the direction of transporting the roll of recording material, and a recording apparatus having such a roll recording material transport device.

2. Related Art

Hereinafter, taking an ink jet printer as an example of a recording apparatus, a description will be made. Some ink jet printers are large-sized ink jet printers that can eject ink onto a large-sized recording material, such as A1 plus size or B0 plus size paper, thereby executing recording. This type of large-sized ink jet printers mainly use a roll of recording material with a width of 24 inches (about 610 mm), 36 inches (about 914 mm), or 44 inches (about 1,118 mm) and a length of 10 m to 45 m. There are used many types of rolls of recording material. They vary in material from paper to film. They range from, for example, resin coated photo paper with high rigidity to plain paper with low rigidity, or from those with a glossy and slippery surface to those with a rough and less slippery surface.

As shown in FIG. 12, roll paper holders 103R and 103L having flange portions 101R and 101L, respectively, are attached to respective ends of the roll of recording material (hereinafter also referred to as roll paper). A spindle 107R is fitted into an engaging hole 105R formed at the center of the roll paper holder 103R. Similarly, a spindle 107L is fitted into an engaging hole 105L formed at the center of the roll paper holder 103L. Engaging projections 109R provided at the base of the spindle 107R engage with engaging step portions 111R of the engaging hole 105R. Similarly, engaging projections 109L provided at the base of the spindle 107L engage with the engaging step portions 111L of the engaging hole 105L. Thus, the power of the spindles 107R and 107L is transmitted through the roll paper holders 103R and 103L, respectively, to the roll paper P.

The spindles 107R and 107L are provided so as to face each other with the roll paper P therebetween. Power is transmitted from a spindle motor 115 through a gear train 113 to the driving side spindle 107R located on the home position side (on the right side of FIG. 12). The driven side spindle 107L located on the other side (on the left side of FIG. 12) is rotatably supported by a support frame 121L with bearings 117 and 119 therebetween.

When the roll paper P is transported by a transport roller (not shown), a desired amount of tension is applied to the roll paper P. To apply the tension, a rotating force is applied to the roll paper P. Types of control for applying the rotating force include tension control shown in FIG. 13A and assist control shown in FIG. 13C. In the tension control, to apply a desired amount of tension to the roll paper P, a motor toque (spindle motor 115) is applied so that a rotating force is applied to the roll paper P in a rewinding direction B, or the opposite direction from the pulling out direction (the direction of transporting the roll paper P) A. However, in the case of the tension control, the tension to be applied to the roll paper P needs to be set equal to or more than the friction torque that is the mechanical load of the support mechanism that supports the roll paper P. Therefore, the tension control cannot be applied to a roll paper P for which a high tension cannot be set, for example, a roll paper P with a slippery surface.

In contrast, in the assist control, a motor toque (spindle motor 115) is applied so that a rotating force is applied to the roll paper P in a direction A such that the transport of the roll paper P is assisted. In the case of the assist control, the tension applied to the roll paper P can be reduced less than the friction torque that is the mechanical load of the support mechanism that supports the roll paper P. Therefore, the assist control can also be applied to a roll paper P with a slippery surface.

However, in FIG. 12, when the mechanical load L1 based mainly on the frictional force $M_1$ between the driving side spindle 107R and the engaging hole 105R in the driving side roll paper holder 103R is larger than the mechanical load L2 based on the frictional force $2M_2$ between the driven side spindle 107L and the bearings 117 and 119, a state can occur in which the engaging projections 109R are out of contact with the engaging step portions 111R as shown in FIG. 13B. That is, depending on whether or not the mechanical load L1 is larger than the mechanical load L2, the engaging projections 109R can exist within the areas between adjacent engaging step portions 111R, and the engagement of the driving side spindle 107R with the driving side roll paper holder 103R in the assist direction can become uncertain or unstable, and the torque applied for the assist control can also become unstable.

To the spindles 107R and 107L, a spring clutch (not shown) is attached, or a torque limiter such as that shown in JP-A-2007-290866 is connected. By the action of the spring clutch or torque limiter, a constant torque serving as a resistance to transport is applied to the roll paper P, and a tension is applied to the roll paper P between the transport roller that guides the roll paper P to the recording position and the roll portion. However, the tension of the roll paper P generated by the action of the spring clutch or torque limiter varies with changes in the roll diameter of the roll paper P. This affects the accuracy of feeding the roll paper P and reduces the recording quality.

SUMMARY

The invention relates to a roll recording material transport device having an assist executing section that executes assist control in which a rotating force is applied to a roll portion of a roll of recording material in the direction of transporting the roll of recording material, and a recording apparatus having such a roll recording material transport device. An advantage of some aspects of the invention is that the engagement of the driving side spindle with the driving side roll holder in the assist direction is ensured and stable assist control can be performed.

According to a first aspect of the invention, a roll recording material transport device includes a driving side roll holder, a driven side roll holder, a driving side spindle, a driven side spindle, a spindle driving source, a driving side support mechanism, a driven side support mechanism, a transport roller, and an assist executing section. The driving side roll holder and the driven side roll holder are attached to respective ends of a roll portion of a roll of recording material. The driving side spindle and the driven side spindle engage with the driving side roll holder and the driven side roll holder, respectively, and support the roll portion. The spindle driving source rotates the driving side spindle in the forward direction and the reverse direction. The driving side support mechanism and the driven side support mechanism support the driving side spindle and the driven side spindle, respectively. The transport roller pinches and transports the roll of recording material pulled out from the roll portion. The assist executing section executes assist control in which a rotating force in the direction of transporting the roll of recording material is applied by the spindle driving source through the driving side spindle and the driving side roll holder in an engaged state to the roll portion. The frictional force between the driving side spindle and the driving side roll holder is set smaller than the frictional force between the driven side spindle and the driven side support mechanism.

According to this aspect of the invention, the frictional force between the driving side spindle and the driving side roll holder is set smaller than the frictional force between the driven side spindle and the driven side support mechanism. Therefore, the torque transmitted from the spindle driving source to the driving side spindle does not go into an unstable state such that it is transmitted to the roll portion of the roll of recording material through the frictional surfaces of the driving side spindle and the driving side roll holder. Slip occurs between the frictional surfaces. The driving side spindle rotates to a position where the engagement of the driving side spindle with the driving side roll holder in the assist direction is ensured, and the driving side spindle stops rotating at the position. Therefore, stable assist control can be performed. Therefore, an appropriate tension can also be applied to a roll of recording material for which a high tension cannot be set, for example, a roll of recording material with a slippery surface. Thereby, the accuracy of feeding this type of roll of recording material can be improved.

According to a second aspect of the invention, a roll recording material transport device includes a pair of roll holders, a pair of spindles, a spindle driving source, a driving side support mechanism, a driven side support mechanism, a transport roller, and an assist executing section. The pair of roll holders are attached to respective ends of a roll portion of a roll of recording material. The pair of spindles engage with the pair of roll holders and support the roll portion. The spindle driving source rotates one of the pair of spindles on the driving side in the forward direction and the reverse direction. The driving side support mechanism and the driven side support mechanism support one of the pair of spindles on the driving side and the other on the driven side, respectively. The transport roller pinches and transports the roll of recording material pulled out from the roll portion. The assist executing section executes assist control in which a rotating force in the direction of transporting the roll of recording material is applied by the spindle driving source through the driving side spindle and the driving side roll holder in an engaged state to the roll portion. When the rotation of the roll portion is at a stop, the driving side spindle, driven by the spindle driving source, overcomes the frictional force with the driving side roll holder and rotates relative to the driving side roll holder and goes into an engaged state in which the rotating force for the assist control is applied to the roll portion.

According to this aspect of the invention, when the rotation of the roll portion is at a stop, the driving side spindle, driven by the spindle driving source, overcomes the frictional force with the driving side roll holder and rotates relative to the driving side roll holder and goes into an engaged state in which the rotating force for the assist control is applied to the roll portion. Therefore, the torque transmitted from the spindle driving source to the driving side spindle does not go into an unstable state such that it is transmitted to the roll portion of the roll of recording material through the frictional surfaces of the driving side spindle and the driving side roll holder. Slip occurs between the frictional surfaces. The driving side spindle rotates to a position where the engagement of the driving side spindle with the driving side roll holder in the assist direction is ensured, and the driving side spindle stops rotating at the position. Therefore, stable assist control can be performed.

It is preferable that the assist executing section include an engaging projection that is provided in the driving side spindle, an engaging step portion that is provided in the driving side roll holder and engages with the engaging projection, and a movement permitting area that is provided in the driving side roll holder and permits the movement of the engaging projection, and that the engaging projection be brought into contact with the engaging step portion by the spindle driving source and execute the assist control.

In this case, by providing the movement permitting area, the insertion of the driving side spindle into the driving side roll holder is facilitated, and the problem of destabilization of the assist control caused by providing the movement permitting area can be effectively prevented.

It is preferable that the roll of recording material be transported intermittently.

At the moment the transport roller rotates and the roll of recording material is pulled out from the roll portion, only the driving side roll holder integral with the roll portion can rotate first, and the engagement between the driving side spindle and the driving side roll holder in the assist direction can become incomplete. To solve this problem, when the rotation of the roll of recording material is at a stop according to the intermittent transport, by the driving force of the spindle driving source in operation, the driving side spindle slips on the frictional surface and rotates and goes into the original engaged state with the driving side roll holder. Therefore, the accuracy of feeding the roll of recording material can be further improved.

It is preferable that the driving side support mechanism and the driven side support mechanism include bearings that rotatably support the driving side spindle and the driven side spindle and support frames that support the bearings, and that the support frame on the driven side include a friction applying member that generates the frictional force of the driven side spindle.

In this case, since the support frame on the driven side includes a friction applying member that generates the frictional force of the driven side spindle, the frictional force between the driven side spindle and the driven side support mechanism can be set larger than the frictional force between the driving side spindle and the driving side roll holder, with simple structure. That is, the frictional force on the driven side can be easily rendered larger than the frictional force on the driving side.

According to a third aspect of the invention, a recording apparatus includes a roll recording material transport device and a recording executing device. The roll recording material transport device pulls out a roll of recording material and transports the roll of recording material to a recording position. The recording executing device ejects ink onto a recording surface of the roll of recording material transported to the recording position and thereby executes desired recording. The roll recording material transport device is the roll recording material transport device according to the first aspect of the invention.

According to this aspect of the invention, the same effects as the above aspects of the invention can be obtained. By the improvement of the stability and accuracy of feeding the roll of recording material, the recording quality can be further improved.

BRIEF DESCRIPTION OF THE DRAWINGS

The invention will be described with reference to the accompanying drawings, wherein like numbers reference like elements.

DESCRIPTION OF EXEMPLARY EMBODIMENTS

A roll recording material transport device and a recording apparatus having the roll recording material transport device according to the invention will hereinafter be described. First, an ink jet printer 100 will be taken up as a best mode for carrying out the invention, and the outline of the overall configuration thereof will be described with reference to the drawings. The ink jet printer 100 to be described is a large-sized ink jet printer that can execute desired recording on the recording surface of a large-sized, for example, A3 plus size or larger sheet of recording material (hereinafter also referred to as single sheets of paper) or a large-sized, for example, A1 plus size or B0 plus size roll of recording material (also referred to as roll paper) P.

Figure 1:
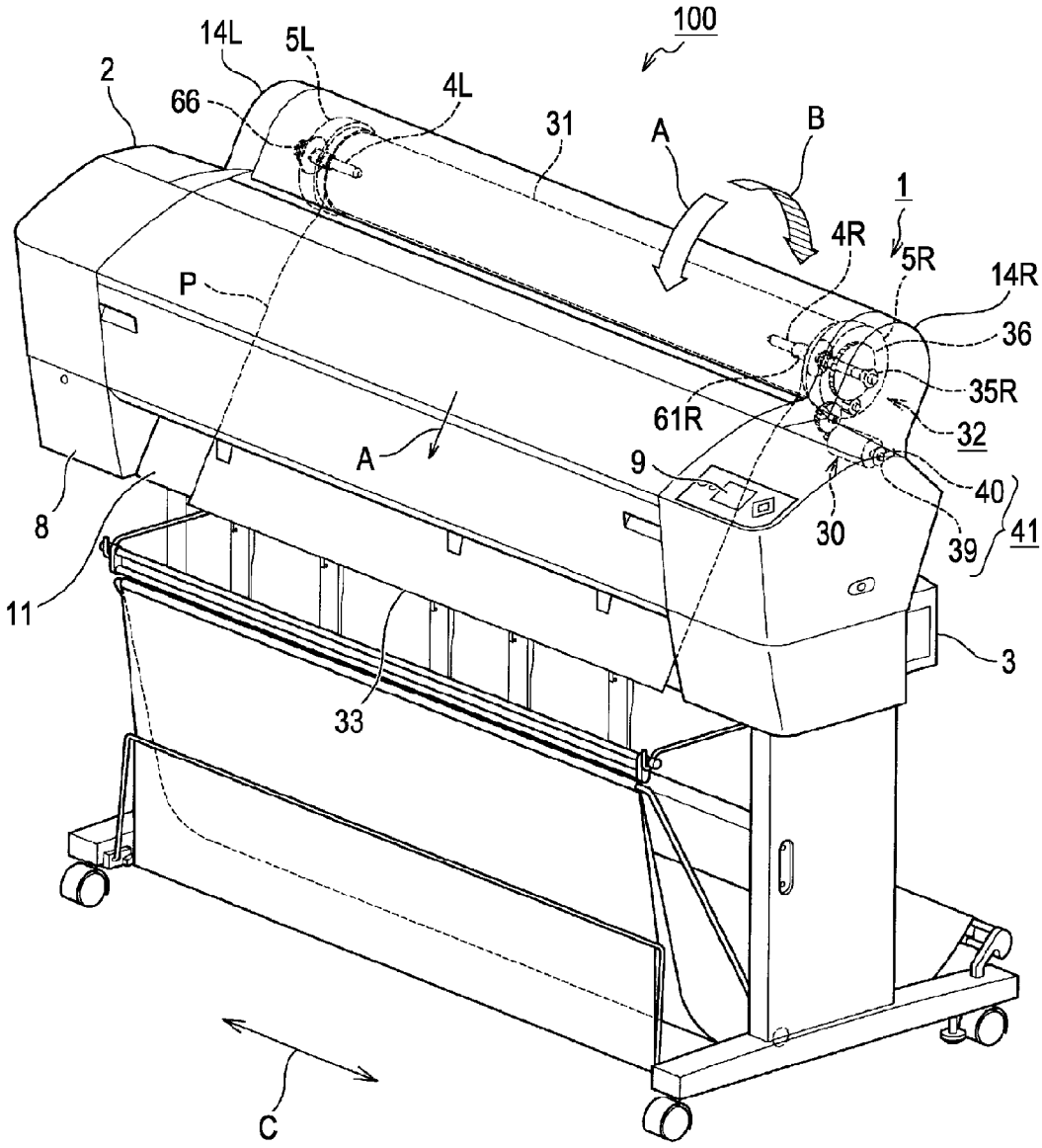
FIG. 1 is a perspective view showing the appearance of an ink jet printer.
Figure 2:
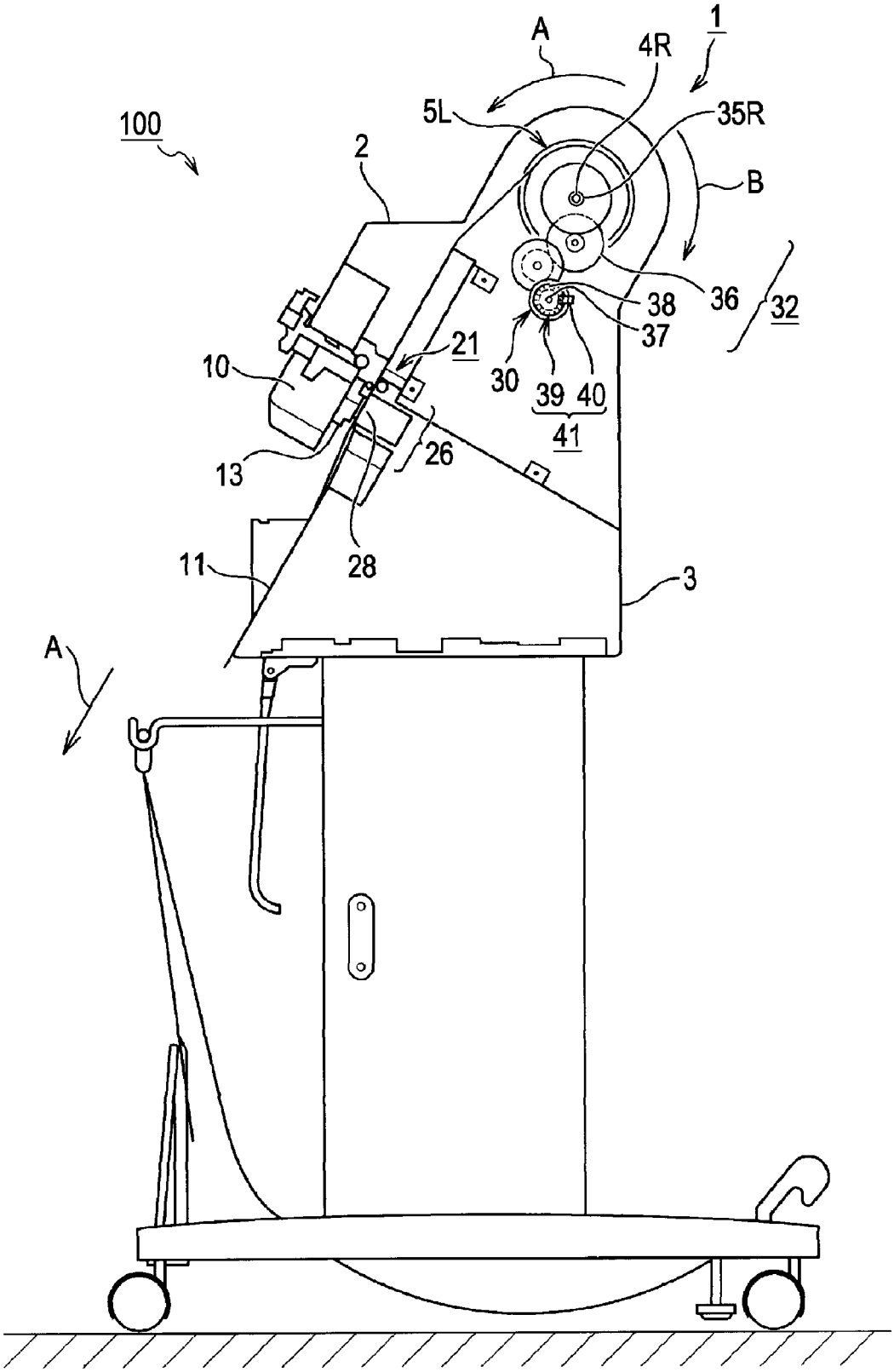
FIG. 2 is a side sectional view showing an ink jet printer with a main body cover removed therefrom.
Figure 3:
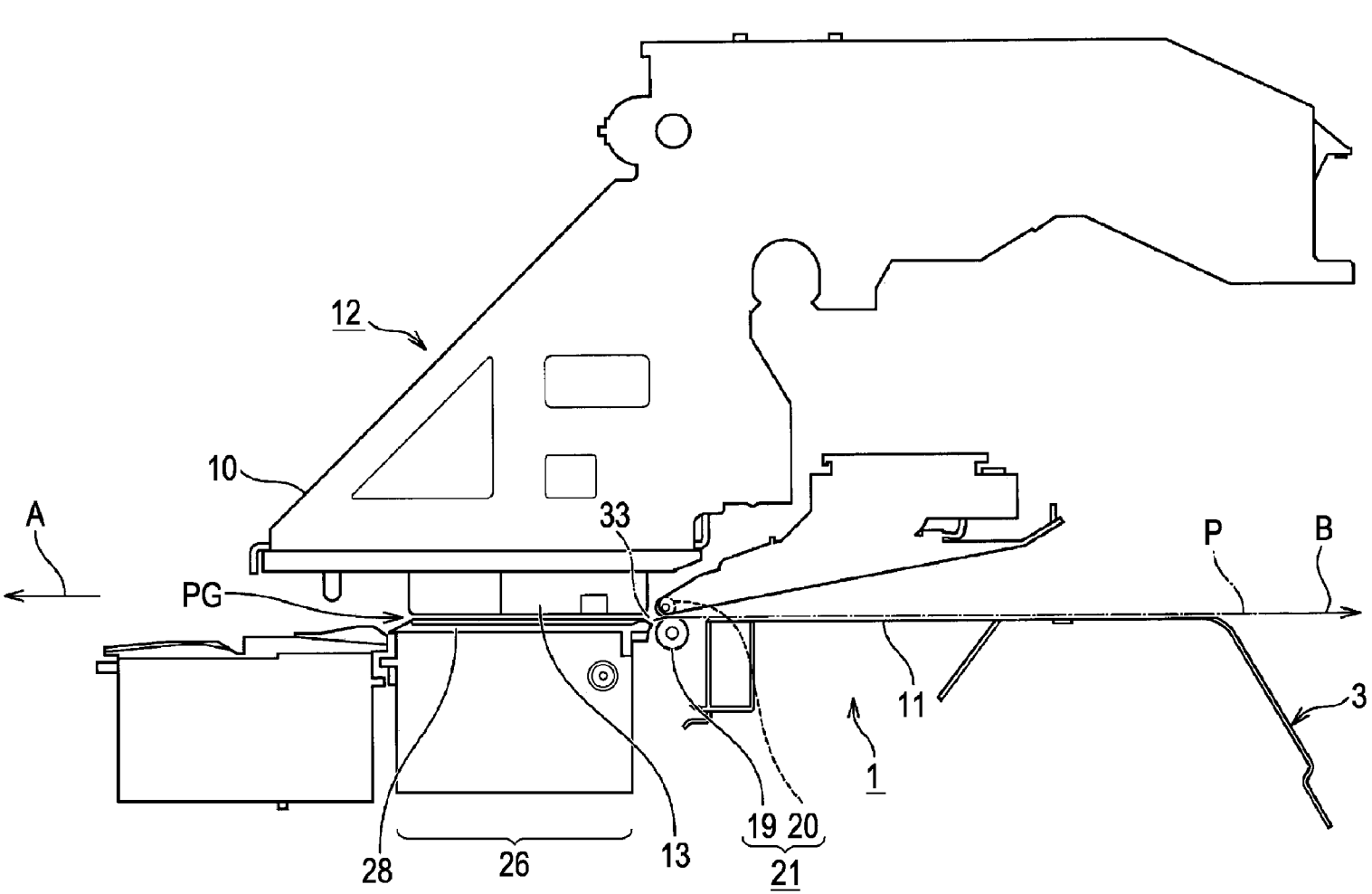
FIG. 3 is a side sectional view showing the outline of the internal structure of an ink jet printer.

FIG. 1 is a perspective view showing the appearance of an ink jet printer with a main body cover attached thereto. FIG. 2 is a side sectional view showing the ink jet printer with the main body cover removed therefrom. FIG. 3 is an essential part side sectional view showing the outline of the internal structure of the ink jet printer.

The shown ink jet printer 100 has a printer main body 3 that is an example of a recording apparatus main body. The printer main body 3 is covered by a main body cover 2 as shown in FIG. 1. In the upper part of the rear of the printer main body 3 are provided a pair of spindles that can hold a roll paper P horizontally: a driving side spindle 4R and a driven side spindle 4L. A pair of holders: a driving side holder 6R and a driven side holder 6L have flange portions 6R and 6L, respectively. Held by the holders 5R and 5L, the roll paper P rotates integrally with the driving side spindle 4R and the driven side spindle 4L. In, for example, the left part of the front of the printer main body 3 is provided a cartridge holder 8, which has a plurality of cartridge slots into which respective colors of ink cartridges can be loaded separately.

In, for example, the right part of the front of the ink jet printer 100 is provided an operation panel 9 through which various operation commands are input. The printer main body 3 is provided with a transport guide plate 11 that slopes down to the front at an angle of about 60°. The transport guide plate 11 guides the roll paper P held horizontally by the driving side spindle 4R and the driven side spindle 4L so that the roll paper P can be transported forward and downward, or in the direction A of pulling out the roll paper P. The printer main body 3 is provided with a roll recording material transport device 1 of the invention and a recording executing device 12. The roll recording material transport device 1 transports the roll paper P to a downstream recording position 26, while pulling out the roll paper P. The recording executing device 12 ejects ink onto the recording surface of the roll paper P transported to the recording position 26, thereby executing desired recording.

The recording executing device 12 is provided obliquely above the recording position 26. The recording executing device 12 has a recording head 13 and a carriage 10. The recording head 13 directly ejects ink, thereby executing recording. The carriage 10 reciprocates in the scanning direction, or the roll width direction C with the recording head 13 mounted thereon. Under the recording position 26 is provided a platen 28, which supports the underside of the roll paper P and thereby defines the gap PG between the roll paper P and the underside of the recording head 13.

Embodiment

Next, a roll recording material transport device 1 according to an embodiment of the invention that can be applied to the ink jet printer 100 configured as described above will be described specifically with reference to the drawings.

Figure 4:
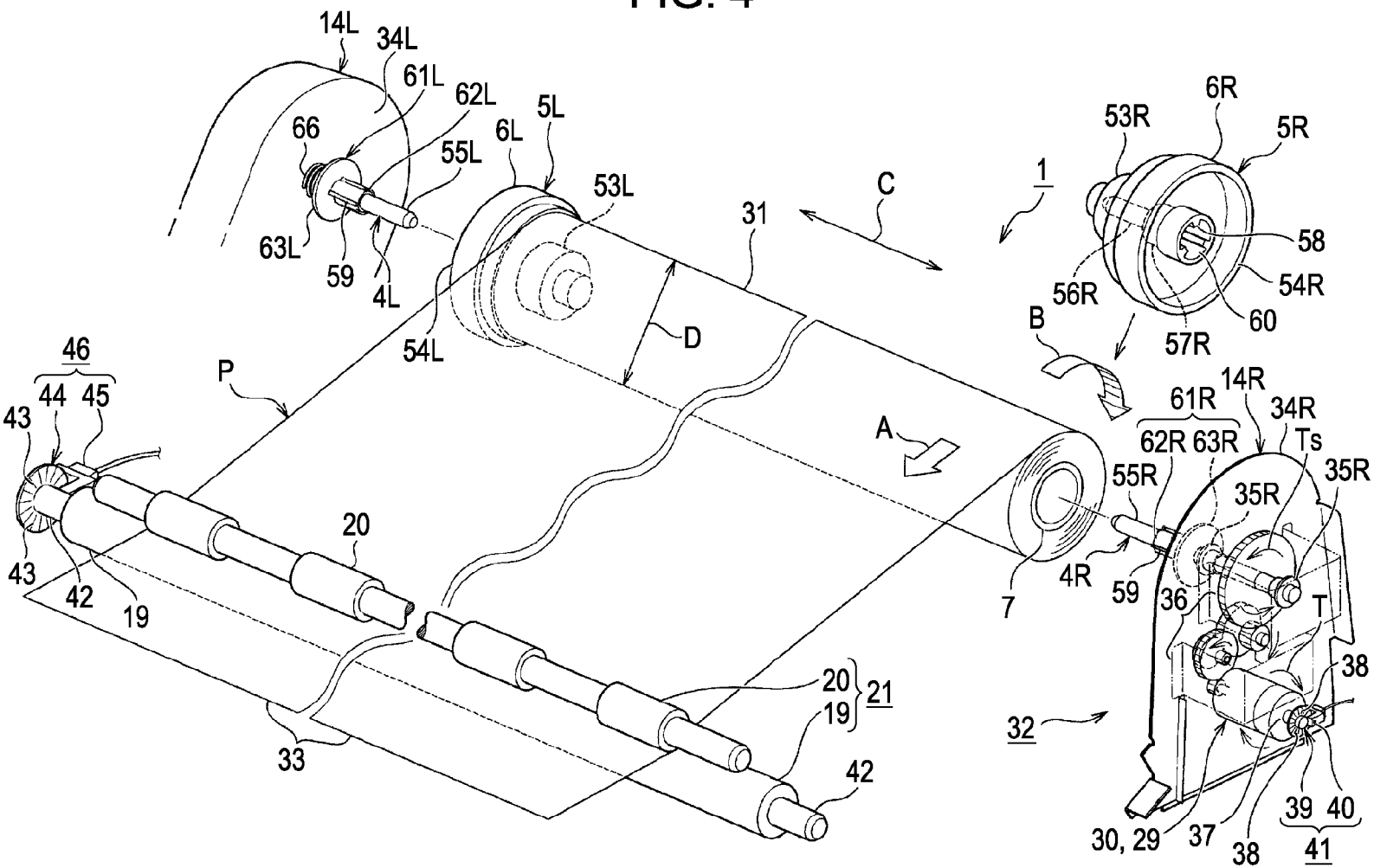
FIG. 4 is an exploded perspective view showing a roll paper and a roll paper rewind mechanism.
Figure 5:
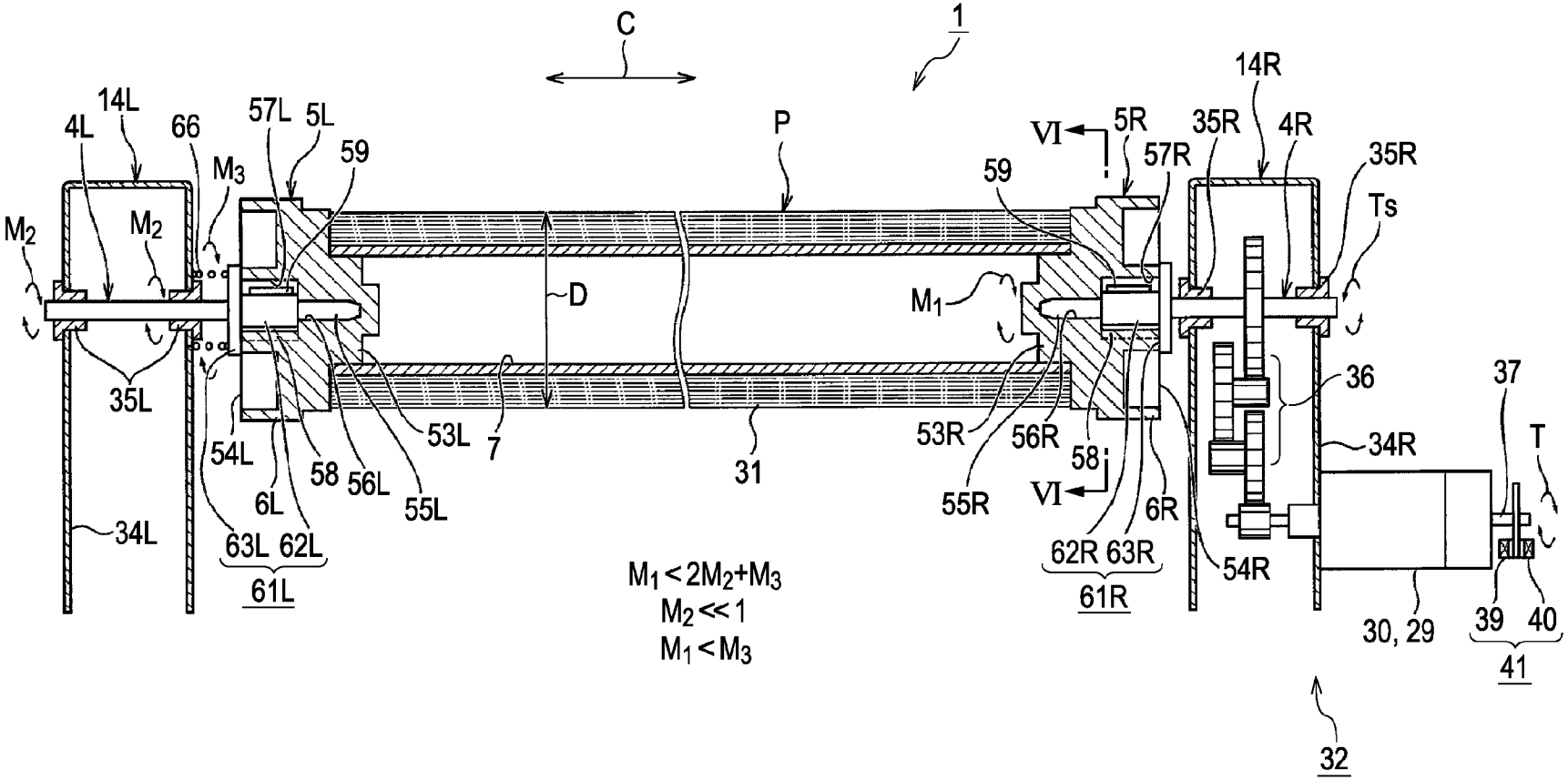
FIG. 5 is a front sectional view showing a roll recording material transport device of the invention.
Figure 6:
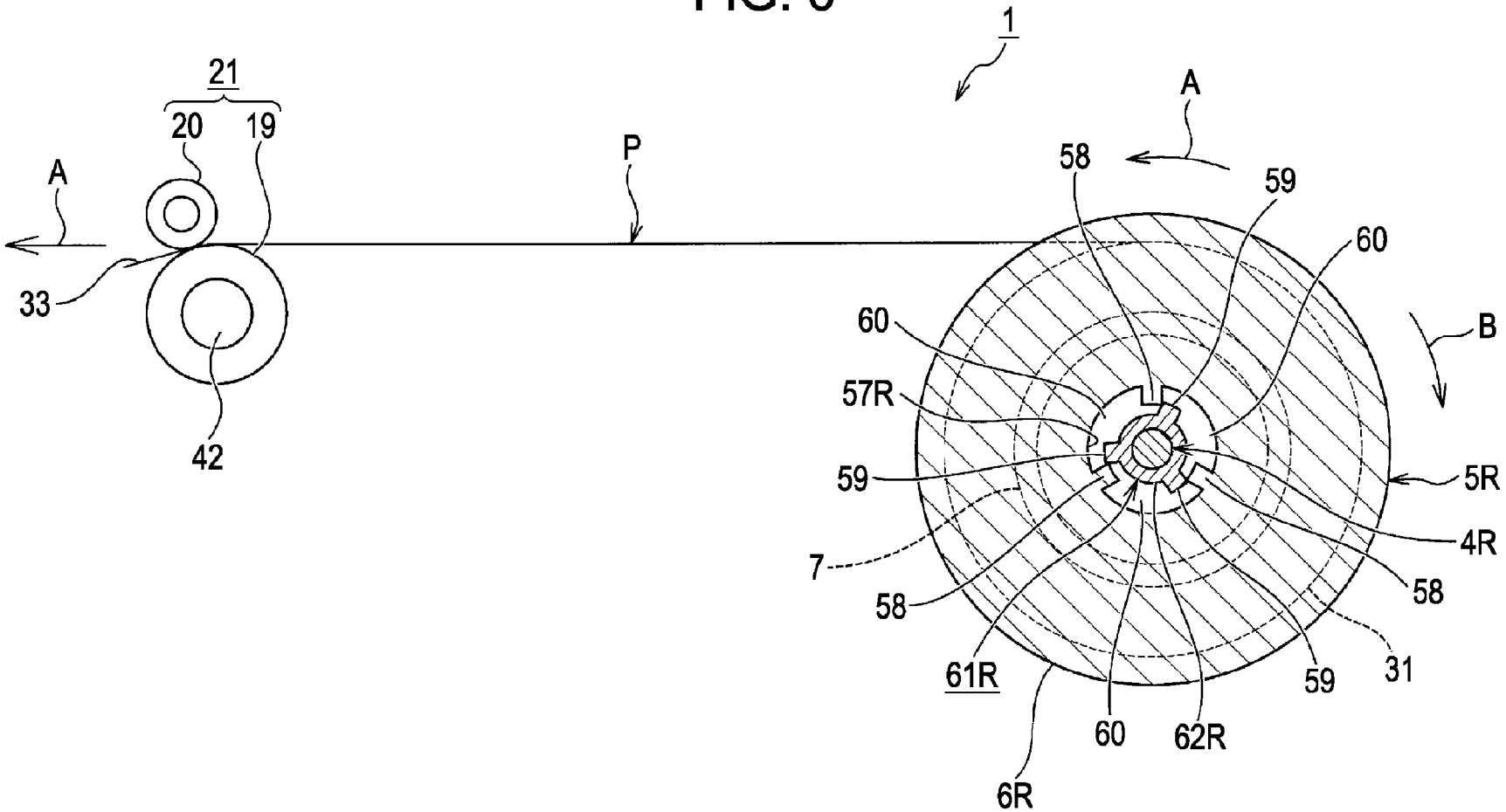
FIG. 6 is a sectional view taken along line VI-VI of FIG. 5.
Figure 7:
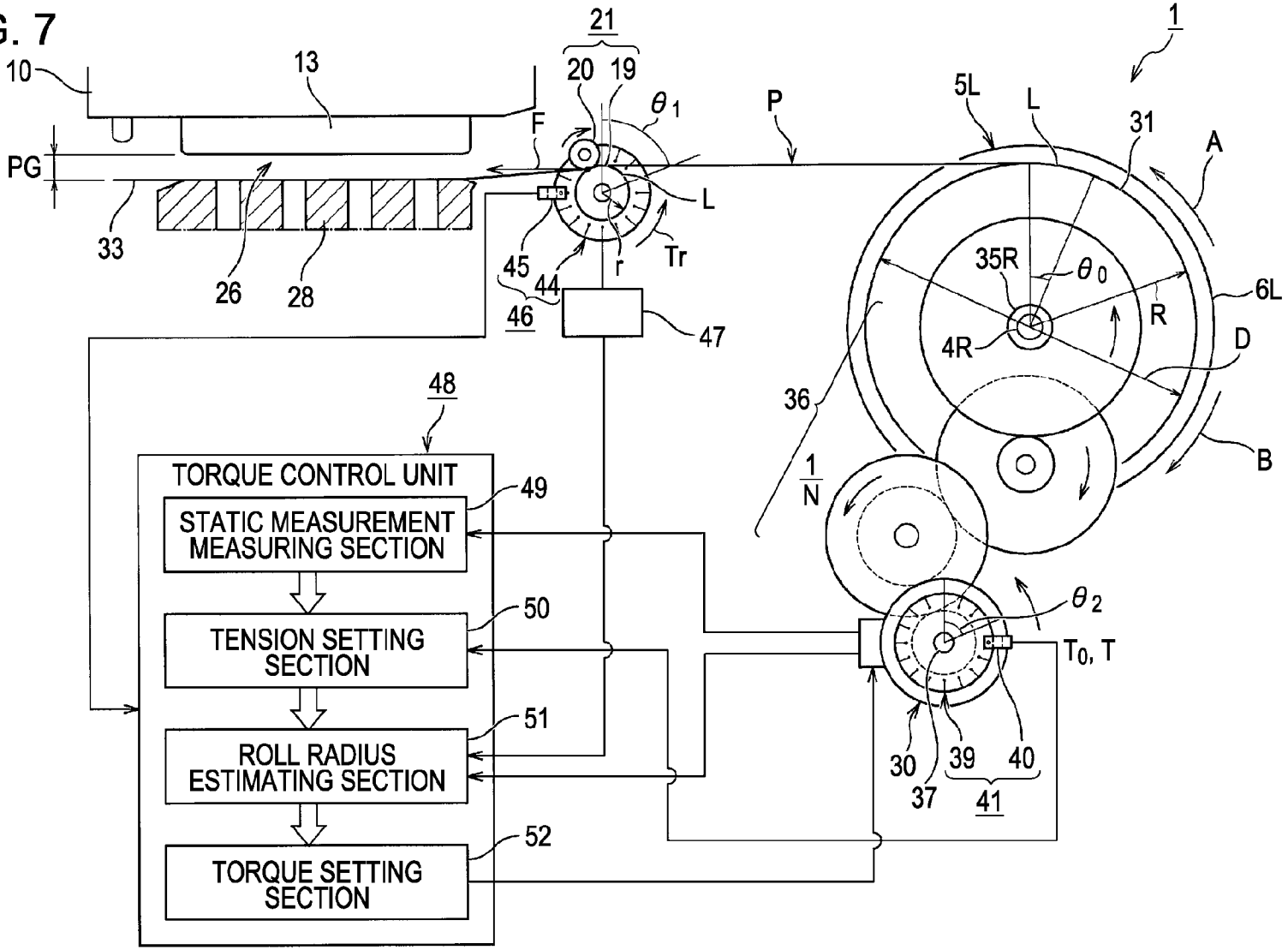
FIG. 7 is a side sectional view showing a roll recording material transport device of the invention.

FIG. 4 is an exploded perspective view showing a roll paper and a roll paper rewind mechanism of this embodiment. FIG. 5 is a vertical sectional view showing a roll recording material transport device of this embodiment. FIG. 6 is a sectional view taken along line VI-VI of FIG. 5. FIG. 7 is a side sectional view showing the roll recording material transport device of this embodiment.

The roll recording material transport device 1 of this embodiment basically has a driving side roll holder 5R, a driven side roll holder 5L, a driving side spindle 4R, a driven side spindle 4L, a spindle motor 30, a driving side support mechanism 14R, and a driven side support mechanism 14L. The driving side roll holder 5R and the driven side roll holder 5L are attached to respective ends of a roll portion 31 of a roll paper P. The driving side spindle 4R and the driven side spindle 4L engage with the driving side roll holder 5R and the driven side roll holder 5L, respectively, and support the roll portion 31. The spindle motor 30 is an example of a spindle driving source that rotates the driving side spindle 4R in the forward direction A and the reverse direction B. The driving side support mechanism 14R and the driven side support mechanism 14L hold the driving side spindle 4R and the driven side spindle 4L horizontally.

The roll recording material transport device 1 of this embodiment further has a transport roller 21. The transport roller 21 serves as a member that transports the roll paper P. The transport roller 21 includes a transport driving roller 19 and a transport driven roller 20, which pinch and transport the roll paper P pulled out from the roll portion 31. The characteristic configuration of the roll recording material transport device 1 of this embodiment is that the frictional force $2M_2(=M_2+M_2)$ between the frictional surfaces of the driven side spindle 4L and the driven side support mechanism 14L is set larger than the frictional force $M_1$ between the frictional surfaces of the driving side spindle 4R and the driving side roll holder 5R when the assist control is executed, in which a rotating force is applied to the roll portion 31 in a direction such that the transport of the roll paper P is assisted.

The driving side roll holder 5R include a core portion 53R formed integrally with the flange portion 6R. Similarly, the driven side roll holder 5L include a core portion 53L formed integrally with the flange portion 6L. The core portions 53R and 53L are fitted into the roll core 7 of the roll portion 31. The flange portions 6R and 6L are in contact with respective end faces of the roll paper P and supports the roll portion 31. A small-diameter fitting hole 56R and a large-diameter engaging hole 57R are formed at the center of the outer end face 54R of the roll holder 5R in which the flange 6R is provided. Into the fitting hole 56R is fitted the tip portion 55R of the spindle 4R. The engaging hole 57R communicates with the fitting hole 56R. Similarly, a small-diameter fitting hole 56L and a large-diameter engaging hole 57L are formed at the center of the outer end face 54L of the roll holder 5L in which the flange 6L is provided. Into the fitting hole 56L is fitted the tip portion 55L of the spindle 4L. The engaging hole 57L communicates with the fitting hole 56L. Into these large-diameter engaging holes 57R and 57L are fitted below-described engaging portions of the spindles 4R and 4L, respectively. On the inner surface of each of the engaging holes 57R and 57L, for example, three engaging step portions 58 are provided at equal pitches in a protruding state. The spaces between these engaging step portions 58 serve as movement permitting areas 60 that permit the movement of engaging projections 59 to be described below.

The spindles 4R and 4L are elongate metal round bar-like members. The tip portions 55R and 55L are tapered to facilitate insertion into the fitting holes 56R and 56L, respectively. Behind the tip portion 55R of the spindle 4R is provided integrally therewith an engaging portion 61R, which engages with the large-diameter engaging hole 57R so that rotation power is transmitted to the roll portion 31. Similarly, behind the tip portion 55L of the spindle 4L is provided integrally therewith an engaging portion 61L, which engages with the large-diameter engaging hole 57L. The engaging portion 61R includes a base portion 62R and a flange portion 63R that are formed integrally. The flange portion 63R comes into contact with the outer end face 54R of the driving side roll holder 5R. The engaging portion 61R is configured to rotate integrally with the spindle 4R. Similarly, the engaging portion 61L includes a base portion 62L and a flange portion 63L that are formed integrally. The flange portion 63L comes into contact with the outer end face 54L of the driven side roll holder 5L. The engaging portion 61L is configured to rotate integrally with the spindle 4L. On each of the base portions 62R and 62L, for example, three engaging projections 59 are provided at equal pitches. The engaging projections 59 engage with the engaging step portions 58 of the roll holders 5R and 5L.

The spindle motor 30 serves as a tension generator 29 that subjects the roll paper P between the transport roller 21 and the roll portion 31 to a constant setting tension F. By controlling the setting torque T of the spindle motor 30 according to the actual roll diameter D (or roll radius R) of the roll portion 31 of the roll paper P at the time, the setting tension F of the roll paper P is rendered constant.

The spindles 4R and 4L and the spindle motor 30 are components of a roll rewind mechanism 32. The roll rewind mechanism 32 is used, for example, for returning the beginning 33 of the roll paper P pulled out in the pulling out direction A, for example, with the execution of recording, to the origin position. In addition, the roll rewind mechanism 32 also plays a role in subjecting the roll paper P between the transport roller 21 and the roll portion 31 to tension.

The roll rewind mechanism 32 basically includes: the spindles 4R and 4L that supported by the support mechanisms 14R and 14L rotatably and horizontally; the spindle motor 30 that are provided in the lower part of the driving side support mechanism 14R located, for example, on the observer's right; and a gear train 36 that is provided between the driving side spindle 4R and the output shaft of the spindle motor 30 and decelerates the rotation of the output shaft of the spindle motor 30 and transmits the decelerated rotation to the driving side spindle 4R.

The driving side support mechanism 14R includes, for example, two bearings 35R that support the driving side spindle 4R rotatably, and a support frame 34R that supports the bearings 35R. Similarly, the driven side support mechanism 14L includes, for example, two bearings 35L that support the driven side spindle 4L rotatably, and a support frame 34L that supports the bearings 35L. Between the flange portion 63L of the driven side engaging portion 61L and the driven side support frame 34L, a compression coil spring 66, which is an example of a friction applying member, is provided in a compressed state. By the urging force of the compression coil spring 66, a frictional force is generated between the flange portion 63L of the driven side engaging portion 61L and the driven side support frame 34L.

Let Ts denote the torque of the driving side spindle 4R when the spindle motor 30 rotates with a setting torque T. Let $M_1$ denote the frictional force between the fitting hole 56R of the driving side roll holder 5R and the tip portion 55R of the driving side spindle 4R. Let $M_2$ denote the frictional force between the bearings 35L on the driven side and the driven side spindle 4L. Let $M_3$ denote the frictional force applied to the driven side spindle 4L on the basis of the compression coil spring 66 serving as the friction applying member. $M_1$, $M_2$, and $M_3$ are set so that the relationship of $$M_1<2M_2+M_3$$

is established. When $M_2$ is very small, frictional forces $M_1$ and $M_3$ may be set so that the relationship of $M_1<M_3$ is established, without considering the value of $M_2$.

When frictional forces $M_1$, $M_2$, and $M_3$ are set so that such a relationship is established, the roll paper P can be prevented from rotating in an unstable state in which the engaging projections 59 is out of contact with the engaging step portions 58. Therefore, the assist control of the roll paper P under a low setting tension F can be performed, and stable and accurate feeding of a roll paper P with a slippery surface can be achieved.

In this embodiment, on the rear surface of the spindle motor 30, a shaft portion 37 is provided in a protruding state. The shaft portion 37 rotates integrally with the spindle motor 30. To the shaft portion 37 is attached a disk-like detection plate 39 in which many slits 38 are formed in a radial manner at equal pitches. Near the detection plate 39 is provided in a noncontact manner a detector 40 that detects the rotation angle $\theta_2$ of the spindle motor 30 by the slits 38. The detection plate 39 and the detector 40 constitute a rotary encoder 41. The rotary encoder 41 forms a first detecting section that indirectly detects the amount of rotation of the roll portion 31.

The roller shaft 42 of the transport driving roller 19 is also equipped with a disk-like detecting plate 44 in which many slits 43 are formed in a radial manner at equal pitches. Near the detection plate 44 is provided in a noncontact manner a detector 45 that detects the rotation angle $\theta_1$ of the transport driving roller 19 by the slits 43. The detection plate 44 and the detector 45 constitute a rotary encoder 46. The rotary encoder 46 forms a second detecting section that detects the amount of rotation of the transport roller 21.

In this embodiment, near the transport driving roller 19 is provided a torque measuring section 47 that measures the operating torque Tr of the transport driving roller 19 in a roll radius estimating process described below and shown in FIG. 7. The operating torque Tr of the transport driving roller 19 can be thereby changed. The operating torque Tr of the transport driving roller 19 may be constant. In this case, the torque measuring section 47 is not necessary.

A roll recording material transport device 1 according to this embodiment is provided with a torque control unit 48. The torque control unit 48 controls the setting torque T of the spindle motor 30 in response to the change in the roll diameter D of the roll portion 31 so that a constant setting tension F acts on the roll paper P between the transport roller 21 and the roll portion 31 regardless of the change in the roll diameter D of the roll portion 31.

The torque control unit 48 includes a static measurement measuring section 49, a tension setting section 50, a roll radius estimating section 51, and a torque setting section 52. The static measurement measuring section 49 measures the offset torque $T_0$ of the spindle motor 30 under static load. The tension setting section 50 sets the setting tension F of the roll paper P on the basis of the operating torque Tr of the transport driving roller 19 and the roller radius r of the transport driving roller 19. The roll radius estimating section 51 estimates the roll radius R of the roll paper P on the basis of the rotation angle $\theta_2$ of the spindle motor 30 and the rotation angle $\theta_1$ of the transport driving roller 19 detected by the two rotary encoders 41 and 46, the roller radius r of the transport driving roller 19, and the reduction ratio 1/N of the gear train 36. The torque setting section 52 sets the setting torque T of the spindle motor 30 so that the setting tension F become constant, on the basis of the offset torque $T_0$ of the spindle motor 30 under static load, the setting tension F set by the tension setting section 50, the roll radius R estimated by the roll radius estimating section 51, and the reduction ratio 1/N of the gear train 36.

Figure 8:
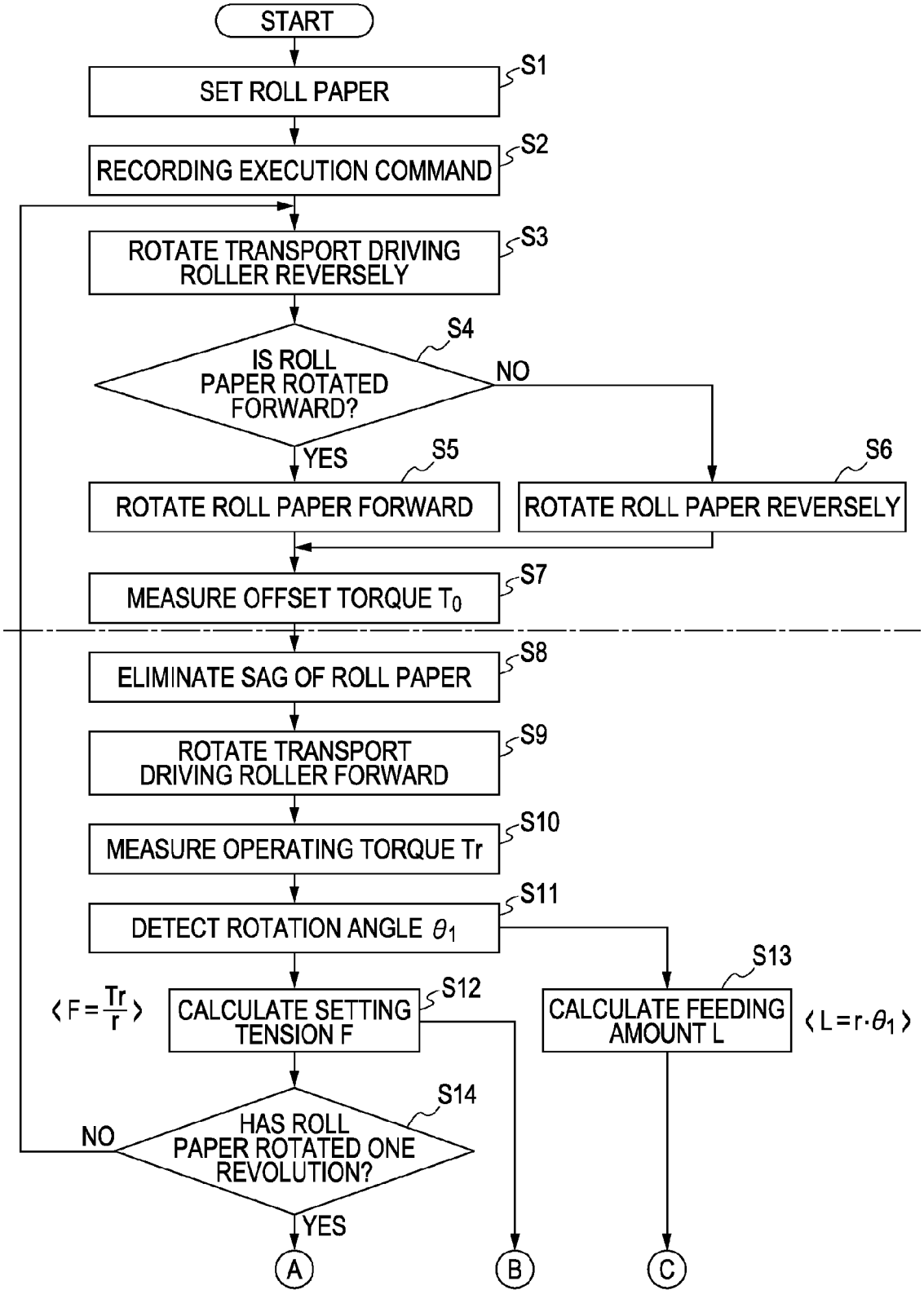
FIG. 8 is a flow chart showing the first half of the control of the setting torque of the spindle motor.
Figure 9:
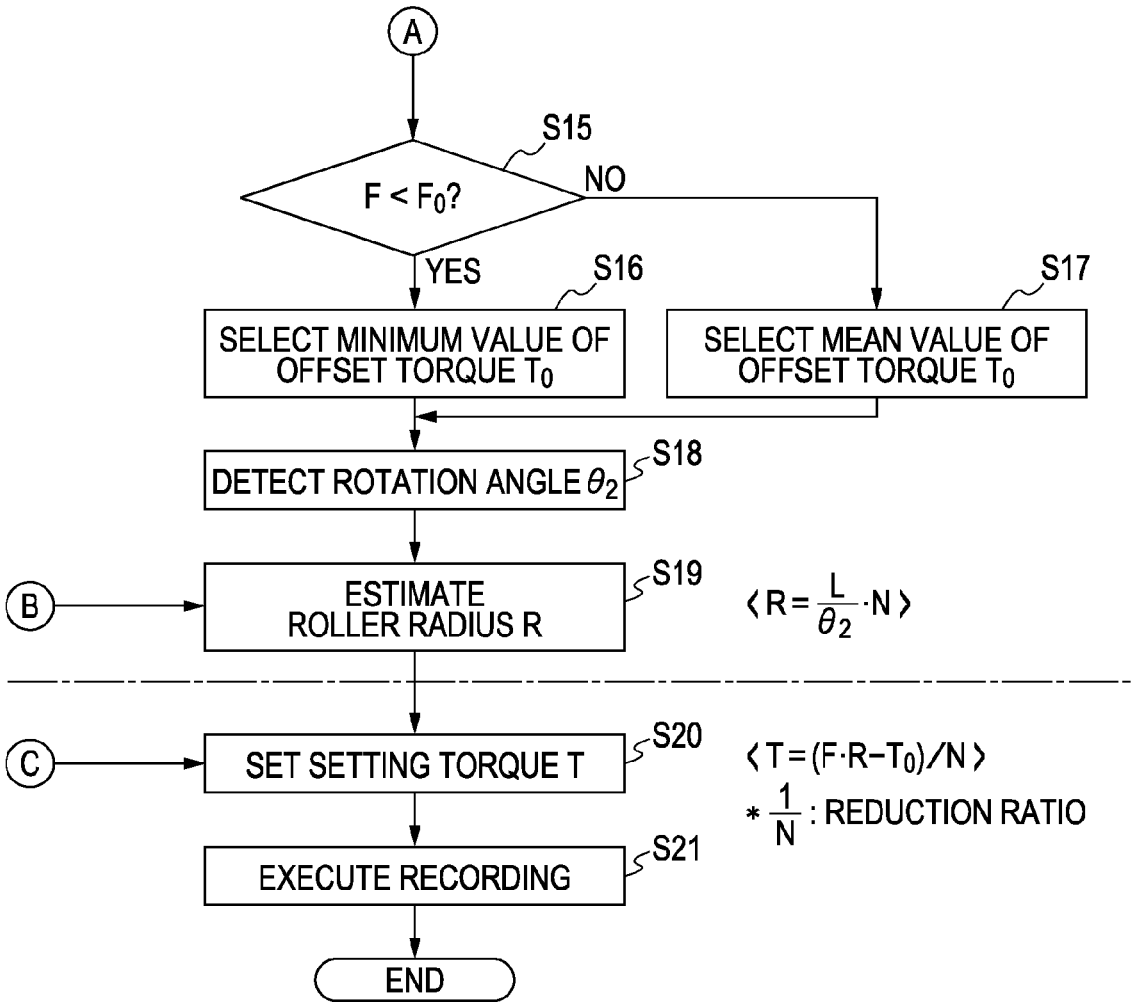
FIG. 9 is a flow chart showing the second half of the control of the setting torque of the spindle motor.

FIG. 8 is a flow chart showing the first half of the flow of the control of setting the setting torque of the spindle motor. FIG. 9 is a flow chart showing the second half thereof. Hereinafter, with reference to these flow charts, the procedure to set the torque of the spindle motor 30 will be described in the following four processes (1) to (4).

(1) Static Measurement Measuring Process (see FIGS. 7 and 8)

In step S1, the user sets a roll paper P on the spindles 4L and 4R. Specifically, the user attaches the roll paper holders 5L and 5R to respective ends of the roll paper P and sets the roll paper holder 5L side on the spindle 4L first. Then, the user moves the roll paper P with the spindle 4L toward the spindle 4R and sets the roll paper holder 5R side on the spindle 4R. Next, in step S2, the user performs predetermined recording execution setting and issues a recording execution command.

Next, in step S3, the transport driving roller 19 is rotated reversely to make the roll paper P between the transport roller 21 and the roll portion 31 sag. In step S4, it is determined whether the roll paper P is rotated forward to measure the static measurement in the forward direction or the roll paper P is rotated reversely to measure the static measurement in the reverse direction. Basically, the roll paper P is rotated forward in step S5, and the offset torque $T_0$ under static load when the spindle motor 30 is rotated forward is measured in step S7.

When the static measurement in the reverse direction is measured, the roll paper P is rotated reversely in step S6, and the offset torque $T_0$ under static load when the spindle motor 30 is rotated reversely is measured in step S7. The measurement of the offset torque $T_0$ is performed on the basis of the current value required to rotate the spindle motor 30 forward or reversely.

(2) Tension Setting Process (see FIGS. 7 and 8)

In step S8, the sag of the roll paper P is eliminated. In step S9, the transport driving roller 19 is rotated forward. In step S10, the operating torque Tr of the transport driving roller 19 is measured by the torque measuring section 47. In step S11, the rotation angle $\theta_1$ of the transport driving roller 19 is detected by the rotary encoder 46. Next, in step S12, on the basis of the measured operating torque Tr of the transport driving roller 19 and the known roller radius r, the setting tension F is calculated from the relationship of F=Tr/r.

In step S13, the feeding amount L is calculated on the basis of the detected rotation angle $\theta_1$ of the transport driving roller 19 and the known roller radius r from the relationship of $L=r\cdot\theta_1$. In step S14, it is determined whether or not the roll paper P has rotated one revolution. If the roll paper P has rotated one revolution, control proceeds to the next process, or the roll radius estimating process. If the roll paper P has not yet rotated one revolution, control returns to step S3, and the measurement of the offset torque $T_0$ and the calculation of the feeding amount L are executed again.

When the operating torque Tr of the transport driving roller 19 is constant, this tension setting process is omitted. The tension is appropriately selected from a table of setting tensions preset according to the type of paper or the width of paper.

(3) Roll Radius Estimating Process (see FIGS. 7 and 9)

Next, control proceeds to step S15, where it is determined whether or not the setting tension F is smaller than a preset reference tension $F_0$. If $F<F_0$, control proceeds to step S16, where the minimum value of the measured offset torque $T_0$ is selected. If $F\geqq F_0$, control proceeds to step S17, where the mean value of the measured offset torque $T_0$ is selected. The above reference tension $F_0$ is a reference tension predetermined according to the type of the roll paper P.

In step S18, the rotation angle $\theta_2$ of the spindle motor 30 is detected by the rotary encoder 41. In step 19, the roll radius R of the roll portion 31 is estimated on the basis of the feeding amount L calculated in step S13, the rotation angle $\theta_2$ of the spindle motor 30 detected in step S18, and the known reduction ratio 1/N of the gear train 36 from the relationship of $$R=(L/\theta_2)\cdot N.$$

(4) Torque Setting Process (see FIG. 9)

Next, control proceeds to step S20, where the setting torque T of the spindle motor 30 is set on the basis of the offset torque $T_0$ measured in step S7, the setting tension F determined in step S12, the roll radius R estimated in step S19, and the known reduction ratio 1/N from the relationship of $$T=(F\cdot R-T_0)/N.$$

Then, control proceeds to step S21. Due to the constant setting tension F produced by the setting torque T, recording is executed without being affected by the change in the roll diameter D.

Other Embodiments

Although the roll recording material transport device 1 and the recording apparatus 100 having the roll recording material transport device 1 according to the invention are based on the above-described configuration, of course, modifications, omissions, and so forth may be made without departing from the scope of the invention.

Figure 10:
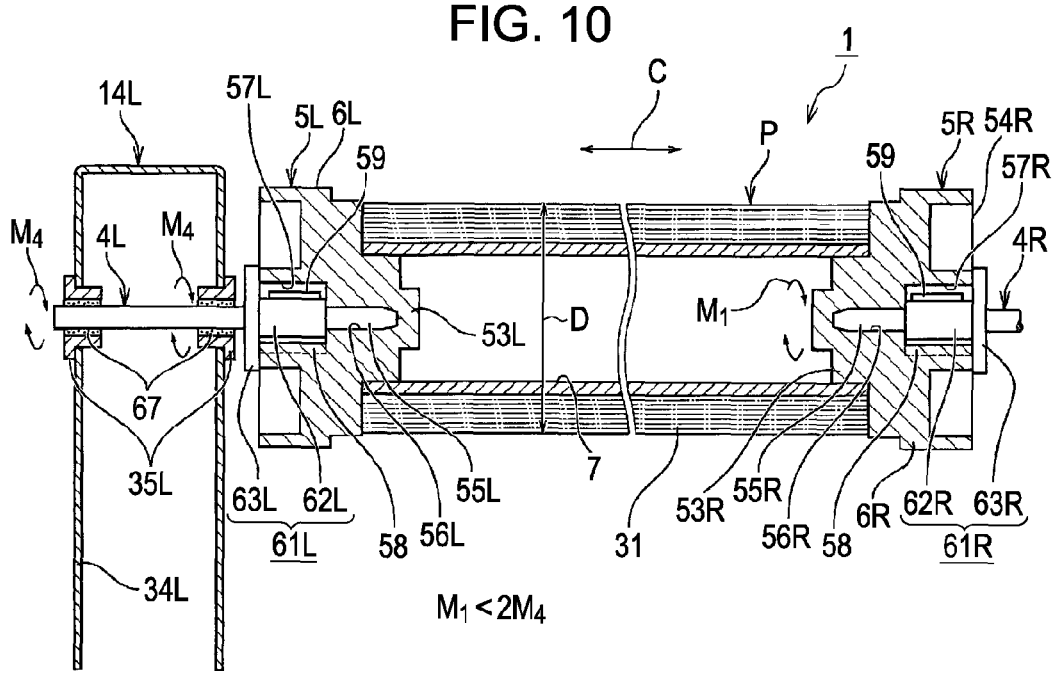
FIG. 10 is a front sectional view showing another embodiment of the invention.

FIG. 10 shows another embodiment in which the frictional force between the driven side spindle 4L and the driven side support mechanism 14L is larger than the frictional force $M_1$ between the driving side spindle 4R and the driving side roll holder 5R. In this embodiment, a cylindrical sleeve-like friction applying member 67 is interposed between each of the two bearings 35L on the driven side and the driven side spindle 4L. If the frictional force between the friction applying member 67 and the driven side spindle 4L is denoted as $M_4$, the frictional forces $M_1$ and $M_4$ are set so that the relationship of $M_1<2M_4$ is established.

Figure 11:
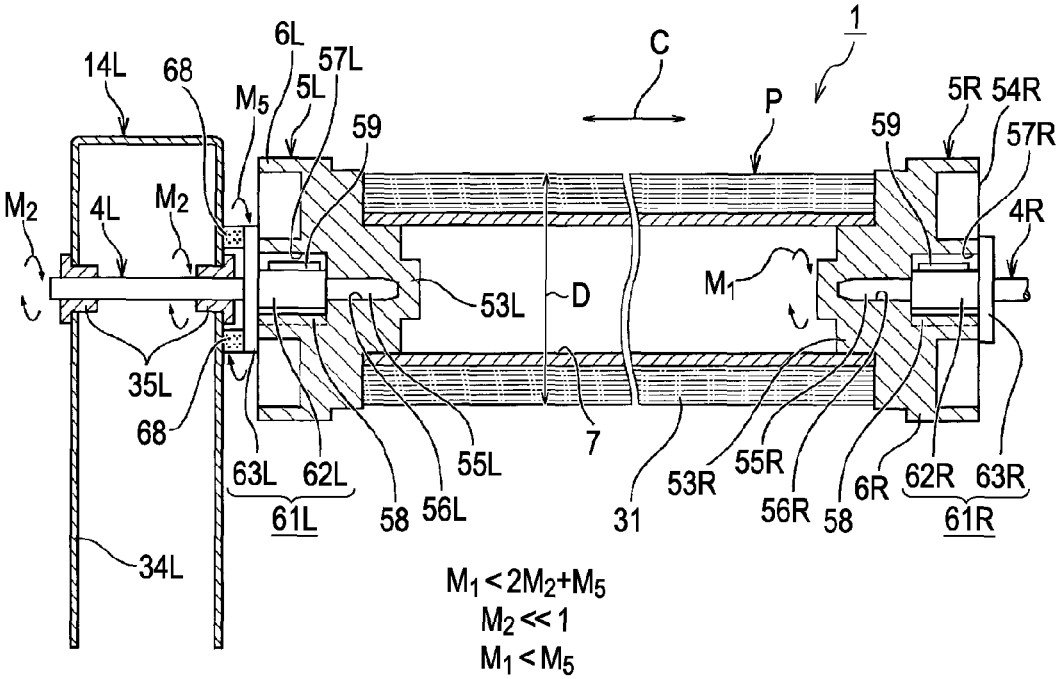
FIG. 11 is a front sectional view showing another embodiment of the invention.
Figure 12:
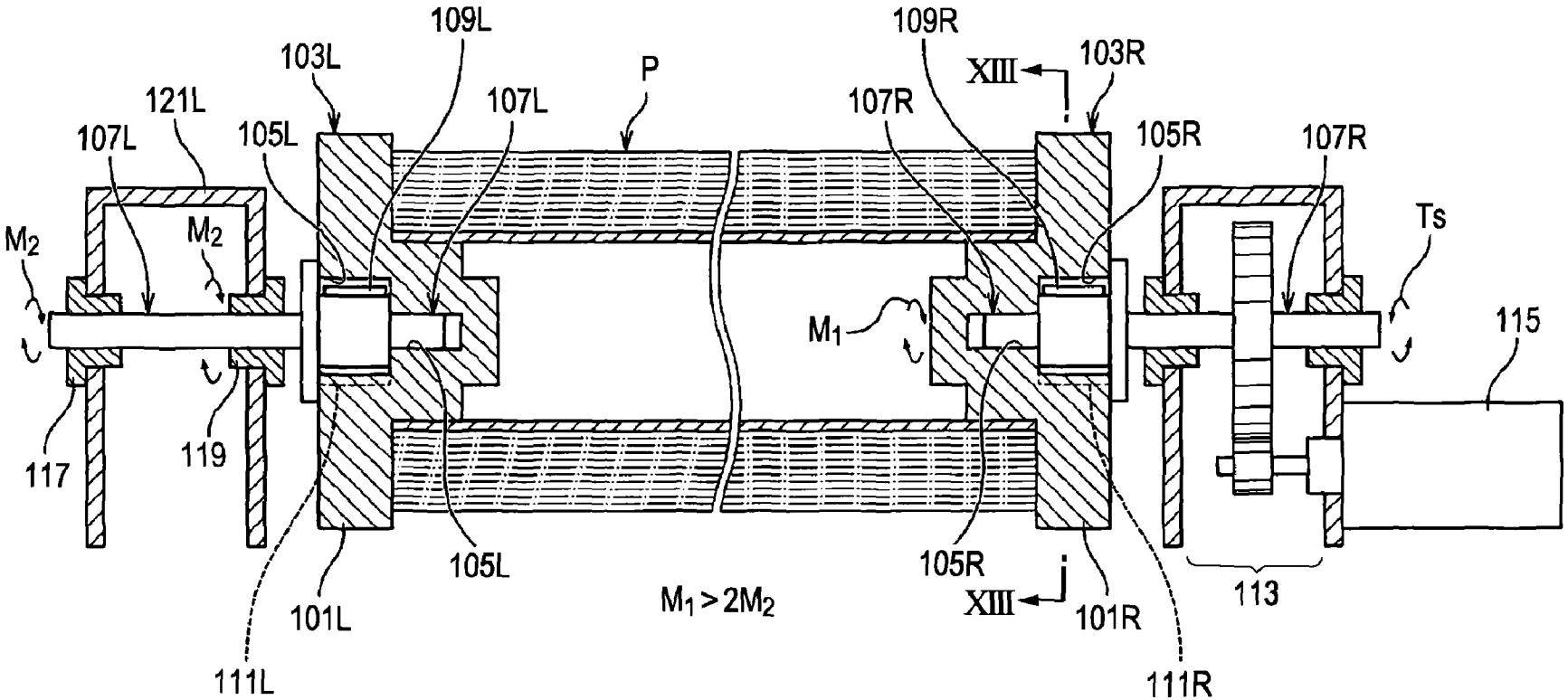
FIG. 12 is a front sectional view showing a known roll recording material transport device.
Figure 13A:
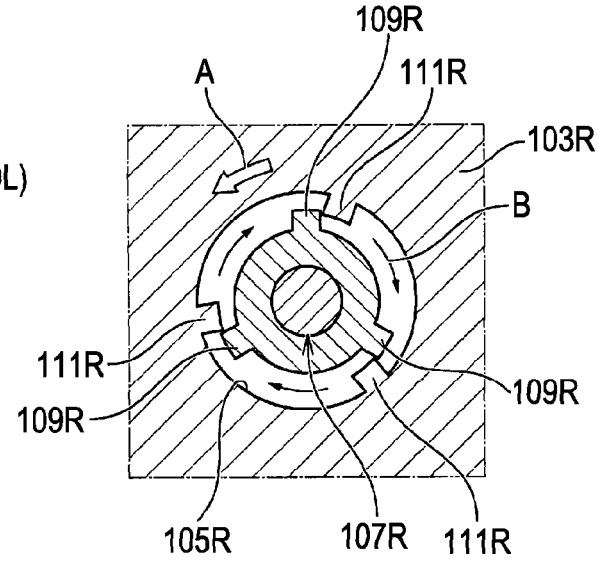
FIG. 13A is a sectional view taken along line XIII-XIII of FIG. 12 and showing a state of tension.
Figure 13B:
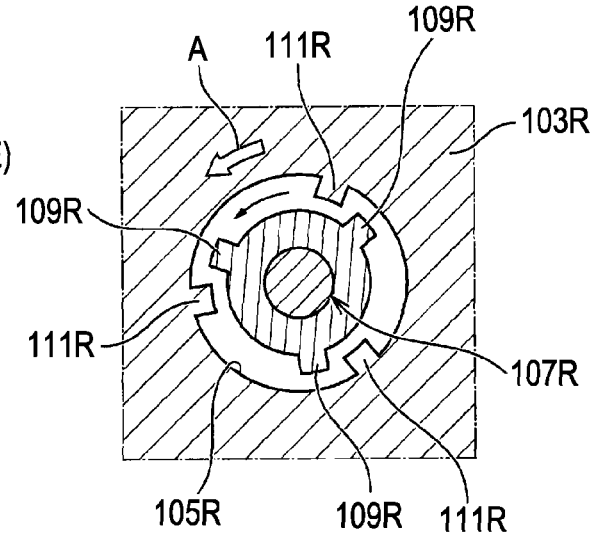
FIG. 13B is a sectional view taken along line XIII-XIII of FIG. 12 and showing an unstable state.
Figure 13C:
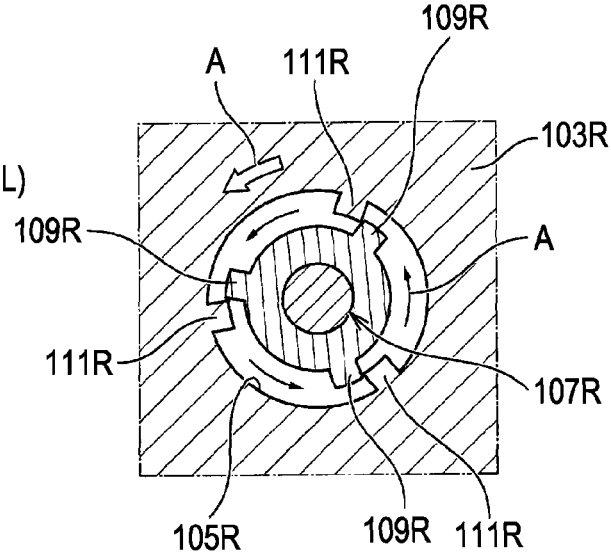
FIG. 13C is a sectional view taken along line XIII-XIII of FIG. 12 and showing a state of assist.

FIG. 11 shows still another embodiment in which the frictional force between the driven side spindle 4L and the driven side support mechanism 14L is larger than the frictional force $M_1$ between the driving side spindle 4R and the driving side roll holder 5R. Instead of the compression coil spring 66 provided in the embodiment shown in FIGS. 4 and 5, a short cylinder-like rubber-like elastic body 68 is provided as a friction applying member. If the frictional force that acts on the driven side spindle 4L due to the rubber-like elastic body 68 is denoted as $M_5$, the frictional forces $M_1$, $M_2$, and $M_5$ are set so that the relationship of $M_1<2M_2+M_5$ is established, and so that the relationship of $M_1<M_5$ is established when $M_2$ is small.

The tension generator 29 is not limited to a spindle motor 30 but may be another type of electric motor or an electromagnetic clutch or brake.

If the spindle motor 30 is capable of low-speed rotation, the output shaft of the spindle motor 30 may be connected directly to the driving side spindle 4R without interposing the gear train 36 or the like therebetween.

What is claimed is:

1. A roll recording material transport device comprising:

a driving side roll holder and a driven side roll holder attached to respective ends of a roll portion of a roll of recording material;

a driving side spindle and a driven side spindle that engage with the driving side roll holder and the driven side roll holder, respectively, and support the roll portion;

a spindle driving source that rotates the driving side spindle in the forward direction and the reverse direction;

a driving side support mechanism and a driven side support mechanism that support the driving side spindle and the driven side spindle, respectively;

a transport roller that pinches and transports the roll of recording material pulled out from the roll portion; and an assist executing section that executes assist control in which a rotating force in the direction of transporting the roll of recording material is applied by the spindle driving source through the driving side spindle and the driving side roll holder in an engaged state to the roll portion, wherein the frictional force between the driving side spindle and the driving side roll holder is set smaller than the frictional force between the driven side spindle and the driven side support mechanism.

2. The roll recording material transport device according to claim 1, wherein the assist executing section includes an engaging projection that is provided in the driving side spindle, an engaging step portion that is provided in the driving side roll holder and engages with the engaging projection, and a movement permitting area that is provided in the driving side roll holder and permits the movement of the engaging projection, and wherein the engaging projection is brought into contact with the engaging step portion by the spindle driving source and executes the assist control.

3. The roll recording material transport device according to claim 1, wherein the roll of recording material is transported intermittently.

4. The roll recording material transport device according to claim 1, wherein the driving side support mechanism and the driven side support mechanism include bearings that rotatably support the driving side spindle and the driven side spindle and support frames that support the bearings, and wherein the support frame on the driven side includes a friction applying member that generates the frictional force of the driven side spindle.

5. A recording apparatus comprising:

a roll recording material transport device that pulls out a roll of recording material and transports the roll of recording material to a recording position; and a recording executing device that ejects ink onto a recording surface of the roll of recording material transported to the recording position and thereby executes desired recording, wherein the roll recording material transport device is the roll recording material transport device according to claim 1.

* * * * *